US010273828B2

(12) United States Patent
Kuhlbach et al.

(10) Patent No.: US 10,273,828 B2
(45) Date of Patent: Apr. 30, 2019

(54) TURBINE HOUSING

(71) Applicant: Ford Global Technologies, LLC, Dearborn, MI (US)

(72) Inventors: Kai Sebastian Kuhlbach, Bergisch Gladbach (DE); Joachim Hansen, Bergisch Gladbach (DE); Ludwig Stump, Cologne (DE); Stefan Quiring, Leverkusen (DE); Jan Mehring, Cologne (DE); Carsten Weber, Leverkusen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 142 days.

(21) Appl. No.: 15/406,592

(22) Filed: Jan. 13, 2017

(65) Prior Publication Data

US 2017/0211419 A1 Jul. 27, 2017

(30) Foreign Application Priority Data

Jan. 22, 2016 (DE) ..... 10 2016 200 873

(51) Int. Cl.

*F01D 25/24* (2006.01)
*F01D 25/12* (2006.01)
*F01D 25/14* (2006.01)

(52) U.S. Cl.

CPC ..... *F01D 25/24* (2013.01); *F01D 25/125* (2013.01); *F01D 25/14* (2013.01); *F05D 2220/40* (2013.01); *F05D 2230/21* (2013.01); *F05D 2260/213* (2013.01)

(58) Field of Classification Search

CPC ..... F01D 25/24; F01D 25/14; F01D 25/125; F05D 2220/40; F05D 2260/213; F05D 2230/21

USPC ..... 60/605.1, 605.2, 605.3

See application file for complete search history.

(56) References Cited

U.S. PATENT DOCUMENTS 6,682,321 B1 * 1/2004 Mukherjee ..... F01D 25/125 415/178
9,464,560 B2 * 10/2016 Kuhlbach ..... F02F 1/243
2009/0241526 A1 * 10/2009 Son ..... F01N 13/10 60/321

(Continued)

FOREIGN PATENT DOCUMENTS

DE 102011002554 A1 7/2012
DE 202014104463 U1 11/2014
EP 2554820 A1 2/2013

(Continued)

*Primary Examiner* — Hoang M Nguyen

(74) *Attorney, Agent, or Firm* — Julia Voutyras; McCoy Russell LLP

(57) ABSTRACT

The internal combustion engine is provided which may include a cylinder head, a turbine, and a turbine housing. The turbine housing may include an exhaust gas passage, at least one coolant fluid passage, and a wall between the passages. The wall may have a first area ($A_{exhaust}$) disposed to absorb heat from an exhaust flow passing through the exhaust gas passage, and a second area ($A_{coolant}$) disposed to transfer heat from the wall to be absorbed by a coolant fluid flow passing through the at least one coolant fluid passage, wherein the following applies: $A_{coolant}/A_{exhaust} \leq 1.2$.

20 Claims, 3 Drawing Sheets

(56) References Cited

U.S. PATENT DOCUMENTS

| | | | | |
|---|---|---|---|---|
| 2015/0050131 | A1* | 2/2015 | Sloss | F01D 9/026<br>415/177 |
| 2015/0292354 | A1* | 10/2015 | Asano | F01D 25/14<br>60/605.1 |

FOREIGN PATENT DOCUMENTS

| | | | |
|---|---|---|---|
| WO | 2009106166 | A1 | 9/2009 |
| WO | 2010039590 | A2 | 4/2010 |

* cited by examiner

TURBINE HOUSING

CROSS REFERENCE TO RELATED APPLICATION

The present application claims priority to German Patent Application No. 102016200873.0, filed on Jan. 22, 2016. The entire contents of the above-referenced application are hereby incorporated by reference in its entirety for all purposes.

FIELD

The present disclosure relates to turbocharger turbine housings, and in particular to a turbine housing able to be formed with a single casting operation and able to modulate an amount of heat removed from an exhaust flow and absorbed into an coolant flow.

BACKGROUND AND SUMMARY

Considerable thermal loading experienced by a turbine housing typically requires using comparatively expensive material. Accordingly, it may be desirable to provide a coolant system to limit the temperature of the turbine housing. However, adding too much heat to the coolant system may be undesirable with regard to other engine systems. In addition, it may be undesirable to cool the exhaust too much. Embodiments disclosed herein provide a thermal transfer mechanism that enables effective heat removal from the exhaust flow, while not overheating other engine systems, or overcooling the engine exhaust.

An internal combustion engine of the form, together with the cylinder liners and the cylinder head, the combustion chambers of the internal combustion engine.

The cylinder head may conventionally serves to hold the valve drives. To control the charge exchange, an internal combustion engine requires control elements and actuating devices for actuating the control elements. During the charge exchange, the exhaust gases are discharged via the outlet openings and the charging of the combustion chamber takes place via the inlet openings. To control the charge exchange, in four-stroke engines, use is made almost exclusively of lifting valves as control elements, which lifting valves perform an oscillating lifting movement during the operation of the internal combustion engine and which lifting valves open and close the inlet openings and outlet openings in this way. The valve actuating mechanism required for the movement of a valve, including the valve itself, is referred to as the valve drive.

Intake lines which lead to the inlet openings, and the exhaust lines which adjoin the outlet openings, may be at least partially integrated in the cylinder head. The merging of exhaust lines to form an overall exhaust line is referred to generally, and also within the context of the present invention, as an exhaust manifold.

Some engines may include an exhaust-gas turbocharger wherein downstream of the outlet openings, the exhaust gases may be supplied to at least one turbine. After the turbine the exhaust gases may pass through one or more exhaust-gas aftertreatment systems.

The production costs for the turbine can be comparatively high because the—nickel-containing—material often used for the thermally highly loaded turbine housing is expensive, in particular in relation to aluminum, which is preferably used for the cylinder head. It is not only the costs for the nickel-containing materials or for the nickel-containing cast steel per se but also the costs for machining these materials which may be comparatively high.

Accordingly, it follows that, with regard to costs, it would be highly advantageous if a turbine could be provided which can be manufactured from a less expensive material, for example gray iron or cast iron, in particular if taken into consideration that a close-coupled arrangement of the turbine is sought and often leads to a relatively large-dimensioned, voluminous housing. This may be because the connection of the turbine and cylinder head by means of a flange and screws may utilize a large turbine inlet region on account of the restricted spatial conditions, and may be because adequate space must be provided for the assembly tools. A voluminous housing can be associated with a correspondingly high level of material usage. The cost advantage is therefore particularly pronounced in the case of a turbine arranged close to the engine on account of the comparatively high material usage. The use of aluminum would have an additional advantage with regard to the weight of the turbine.

Using a cooling arrangement may enable use of cheaper materials. For example with a liquid-type cooling arrangement, which significantly may reduce the thermal loading of the turbine and of the turbine housing by the hot exhaust gases and may therefore permit the use of thermally less highly loadable materials.

In general, the turbine housing may be provided with a coolant jacket in order to form the cooling arrangement. Efforts have been made regarding both concepts wherein the housing is a cast part and the coolant jacket is jointly formed, during the casting process, as an integral constituent part of a monolithic housing, and also concepts in which the housing is of modular construction, wherein during assembly a cavity is formed which serves as a coolant jacket.

A turbine designed according to the latter concept is described for example in the German laid-open specification DE 10 2008 011 257 A1 (Also, WO2009106166 A1). A liquid-type cooling arrangement of the turbine is formed by virtue of the actual turbine housing being provided with a casing, such that a cavity into which coolant can be introduced is formed between the housing and the at least one casing element arranged spaced apart therefrom. The housing which is expanded to include the casing arrangement then comprises the coolant jacket.

The inventors herein have recognized a number of shortcomings with this approach. For example, on account of the high specific heat capacity of a liquid, in particular of water which is conventionally used, large amounts of heat may be extracted from the housing by means of liquid-type cooling. The heat may be dissipated to the coolant in the interior of the housing and may be discharged with the coolant. The heat which is dissipated to the coolant may be extracted from the coolant again in a heat exchanger. It is basically possible for the liquid-type cooling arrangement of the turbine to be equipped with a separate heat exchanger or else—in the case of a liquid-cooled internal combustion engine—for the heat exchanger of the engine cooling arrangement, that is to say the heat exchanger of a different liquid-type cooling arrangement, to be used for this purpose. The latter merely requires corresponding connections between the two circuits. In this context, it must be taken into consideration that the amount of heat to be absorbed by the coolant in the turbine may be so high that it may be a problem for said large amount of heat to be extracted from the coolant in the heat exchanger and discharged by way of an air flow to the surroundings.

Modern motor vehicle drives may be typically equipped with high-powered fan motors in order to provide, at the heat exchangers, the air mass flow required for an adequately high heat transfer. However, a further parameter which is significant for the heat transfer, specifically the surface area provided for the heat transfer, cannot be made arbitrarily large or enlarged arbitrarily because the space availability in the front-end region of a vehicle, in which the various heat exchangers are generally arranged, is limited.

Various concepts have been developed for limiting the amount of heat absorbed by the coolant in the turbine. The German laid-open specification DE 10 2011 002 554 A1 describes a concept in which, in the turbine housing, chambers are provided which are arranged between the exhaust gas-conducting flow duct of the turbine and the coolant duct and which function as a heat barrier, such that the heat flow from the exhaust gas or flow duct to the coolant duct and into the coolant is impeded and thereby reduced. By means of the structural design of the chambers, in particular the shaping, it is possible to influence the heat flows and thus the temperature distribution in the turbine housing.

The inventors herein have recognized problems with this approach well, for example in terms of manufacturing. The production of the chambers, which in some cases may also accommodate a process fluid, is problematic, in particular the removal of the cores required for the production process by way of casting. In some cases, a modular, that is to say multi-part, construction of the turbine housing may be inevitable.

Other concepts for limiting the amount of heat absorbed by the coolant restrict the spatial extent of the at least one coolant duct in the housing of the turbine or provide thermal insulation at the coolant side. One concept of the former type provides for example that the at least one coolant duct does not completely encase, that is to say surround, the impeller of the turbine—similarly to a coolant jacket—but rather extends over the flow duct in a circumferential direction only over a limited angle range $\alpha$, where for example $\alpha \leq 45°$.

Excessive cooling of the turbine or of the turbine housing furthermore may inevitably lead to corresponding considerable cooling of the exhaust gas that is conducted through the turbine. This however, may be fundamentally undesirable. Firstly, it is specifically sought to be able to optimally utilize the exhaust-gas enthalpy of the hot exhaust gases, which is determined significantly by the exhaust-gas temperature, for energy production. Secondly, the exhaust gas is generally subjected, downstream of the turbine, to exhaust-gas aftertreatment, and the exhaust-gas aftertreatment systems used require an adequately high exhaust-gas temperature for the conversion of the pollutants.

Embodiments in accordance with the present disclosure may provide an internal combustion engine is provided which may include a cylinder head, a turbine, and a turbine housing. The turbine housing may include an exhaust gas passage, at least one coolant fluid passage, and a wall between the passages. The wall may have a first area ($A_{exhaust}$) disposed to absorb heat from an exhaust flow passing through the exhaust gas passage, and a second area ($A_{coolant}$) disposed to transfer heat from the wall to be absorbed by a coolant fluid flow passing through the at least one coolant fluid passage, wherein the following applies: $A_{coolant}/A_{exhaust} \leq 1.2$.

The material through which heat may pass from the exhaust flow into the coolant flow may be conceptualized, in cross section, as a trapezoid wherein heat from the exhaust enters the material through the long base of the trapezoid, and heat leaves the material and enters the coolant through the short base of the trapezoid. However, this description should be understood as a conceptual model, and not necessarily limited to a strict trapezoidal shape. Either or both of the "bases" may be straight or curved, continuous or discontinuous. Similarly, $A_{exhaust}$ and $A_{coolant}$ may either, or both, be flat or having relief, continuous or discontinuous; and have relative sizes in accordance with the present disclosure.

In this way, the surface area exposed to coolant $A_{coolant}$ of the liquid-type cooling arrangement of the turbine housing may be restricted in terms of size, that is to say is limited in terms of extent. This may serve for reducing or limiting the amount of heat absorbed, or to be absorbed, by the coolant. The size of the surface area exposed to coolant is a parameter of significance for the heat transfer, in particular for the heat transfer owing to convection.

Proceeding from the surface area exposed to exhaust gas $A_{exhaust}$ of the turbine housing, such as may be present in individual cases and may be formed by the at least one exhaust-gas-conducting flow duct, the surface area exposed to coolant $A_{coolant}$ of the at least one coolant duct may be sized to be no larger than 1.2 times the surface area exposed to exhaust gas. The surface area exposed to coolant of the housing cooling arrangement amounts to, for example, at most 120% of the surface area exposed to exhaust gas of the turbine housing.

By means of the structural design or shaping of the at least one exhaust-gas-conducting flow duct and of the at least one coolant duct, the area ratio and the number and arrangement thereof, it is possible to influence the amount of heat introduced into the coolant, but also the heat flows themselves and thus the temperature distribution in the turbine housing.

In the present case, it is not the aim to encase the at least one flow duct with coolant over the largest possible area and to thus realize the greatest possible dissipation of heat. Rather, through the limitation of the size of the surface area exposed to coolant $A_{coolant}$ of the at least one coolant duct, the amount of heat to be dissipated may be reduced or limited. The problem of having to dissipate large amounts of heat absorbed by the coolant is thus mitigated.

Firstly, the turbine cooling arrangement according to various embodiments may make it possible to dispense with thermally highly loadable nickel-containing materials for producing, in particular, the turbine housing, because the thermal loading of the material may be reduced. Secondly, the cooling power is generally not sufficient to permit the use of materials that can be subjected to only low thermal loading, such as aluminum.

Correspondingly to the moderate cooling power, it may be advantageous, for the production of the liquid-cooled turbine according to the invention, to select a corresponding material, preferably gray iron or cast iron, if appropriate with additives such as for example silicon molybdenum (SiMo).

The turbine may be designed as a radial turbine, that is to say the flow approaching the impeller blades of the at least one impeller runs substantially radially. Here, "substantially radially" means that the speed component in the radial direction is greater than the axial speed component. The speed vector of the flow intersects the shaft or axle of the turbine, specifically at right angles if the approaching flow runs exactly radially. To make it possible for the impeller blades to be approached by flow radially, the at least one flow duct for the supply of the exhaust gas is often designed as an encircling spiral or volute housing, such that the inflow of exhaust gas to the turbine impeller runs substantially radially.

The turbine may however also be designed as an axial turbine, in which the speed component in the axial direction is greater than the speed component in the radial direction.

The above embodiments relating to the turbine encompass all structural forms of the mixed-flow turbine.

Embodiments of the internal combustion engine are advantageous in which a supercharging arrangement, preferably an exhaust-gas turbocharging arrangement, is provided.

In this context, embodiments are advantageous in which the at least one turbine is a constituent part of an exhaust-gas turbocharger. Owing to the relatively high exhaust-gas temperatures, a supercharged internal combustion engine is subject to particularly high thermal loads, for which reason cooling of the turbine of the exhaust-gas turbocharger is advantageous.

Supercharging serves primarily to increase the power of the internal combustion engine. Here, the air required for the combustion process is compressed, as a result of which a greater air mass can be supplied to each cylinder per working cycle. In this way, the fuel mass and therefore the mean pressure can be increased.

Supercharging is a suitable means for increasing the power of an internal combustion engine while maintaining an unchanged swept volume, or for reducing the swept volume while maintaining the same power. In any case, supercharging leads to an increase in volumetric power output and a more expedient power-to-weight ratio. If the swept volume is reduced, it is thus possible, given the same vehicle boundary conditions, to shift the load collective toward higher loads, at which the specific fuel consumption is lower. Supercharging consequently may assist in the constant efforts in the development of internal combustion engines to minimize fuel consumption, that is to say to improve the efficiency of the internal combustion engine.

The advantage of an exhaust-gas turbocharger in relation to a mechanical charger is that no mechanical connection for transmitting power is required between the charger and the internal combustion engine. While a mechanical charger draws the energy required for driving it directly from the internal combustion engine, the exhaust-gas turbocharger utilizes the exhaust-gas energy of the hot exhaust gases.

Embodiments of the internal combustion engine may include at least one cylinder head has at least two cylinders. If the cylinder head has two cylinders and only the exhaust lines of, or exhaust gases from, one cylinder open or issue into the turbine, this is likewise an internal combustion engine according to the invention.

In some cases the cylinder head has three or more cylinders, and the exhaust lines of two cylinders may lead into the turbine.

Embodiments in which the at least one cylinder head has, for example, four cylinders in an in-line arrangement and the exhaust lines of the outer cylinders and the exhaust lines of the inner cylinders merge to form in each case one overall exhaust line are likewise internal combustion engines according to the present disclosure. This may be the case specifically irrespective of whether the two overall exhaust lines open into the same turbine or separately from one another in each case into a separate turbine.

The at least one turbine may be a two-channel turbine. A two-channel turbine has an inlet region with two inlet ducts and two channels, with the two overall exhaust lines being connected to the two-channel turbine in such a way that in each case one overall exhaust line opens into one inlet duct or one channel.

Embodiments may also be advantageous in which the exhaust lines of all the cylinders of the at least one cylinder head may merge to form a single, that is to say common, overall exhaust line, which opens into the at least one turbine.

Embodiments of the internal combustion engine may be advantageous in which the following applies: $A_{coolant}/A_{exhaust} \leq 1.0$.

Embodiments of the internal combustion engine may be advantageous in which the following applies: $A_{coolant}/A_{exhaust} \leq 0.8$.

Embodiments of the internal combustion engine may be advantageous in which the following applies: $A_{coolant}/A_{exhaust} \leq 0.65$.

Embodiments of the internal combustion engine may be advantageous in which the following applies: $A_{coolant}/A_{exhaust} \leq 0.55$.

Embodiments of the internal combustion engine may be advantageous in which the following applies: $A_{coolant}/A_{exhaust} \leq 0.50$.

Embodiments of the internal combustion engine may be advantageous in which the following applies: $A_{coolant}/A_{exhaust} \leq 0.48$ or 0.45.

The above embodiments may make allowance for the fact that the area ratio $A_{coolant}/A_{exhaust}$ duly may be selected so as to be fundamentally smaller in order to reduce the amount of heat introduced into the coolant, but should also be adapted to the respective individual situation or application. Here, the exhaust-gas flow rate and the exhaust-gas temperature have a significant influence on the area ratio that can be realized.

Embodiments of the internal combustion engine are advantageous in which at least one additional coolant duct may lead through a housing tongue that forms the turbine housing at the end of the at least one exhaust-gas-conducting flow duct. The housing tongue, which may constitutes or may jointly form the end of the exhaust-gas-conducting flow duct and which may extend to a point as close as possible to the rotating impeller, is the thermally most highly loaded region of the turbine housing. There may be numerous reasons for this. At least in the case of radial turbines, a part of the exhaust gas passes the housing tongue twice, specifically firstly upon entering the turbine housing, that is to say at the inlet into the exhaust-gas-conducting flow duct which extends in ring-shaped fashion around the impeller, and a second time upon finally entering the rotating impeller at the end of the flow duct. Consequently, the housing tongue may be exposed to hot exhaust gas on both sides, wherein the heat introduced into the tongue by the exhaust gas can be dissipated by heat conduction basically only via a narrow web by which the tongue is connected to the turbine housing itself. The tongue may be thermally loaded by the hot exhaust-gas flow not only on both sides but also at its free end which faces the impeller and which is likewise exposed to hot exhaust gas.

Furthermore, the exhaust-gas flow may be diverted with greater or lesser intensity by the housing tongue in order to conduct the exhaust gas to the impeller. Here, the exhaust-gas flow strikes the housing tongue and has a speed component which is perpendicular to the wall of the tongue, whereby the heat transfer by convection, and consequently the thermal loading of the housing tongue, are increased.

If at least one additional coolant duct is provided, embodiments may be advantageous in this context in which the at least one additional coolant duct runs substantially parallel to the shaft of the turbine. The additional coolant duct may be formed into the housing during the course of a finish machining process, for example by way of drilling, and then runs preferably rectilinearly. The surface area exposed to coolant of the at least one additional coolant duct may also incorporated into the area ratio $A_{coolant}/A_{exhaust}$.

Embodiments of the internal combustion engine are advantageous in which at least one bypass line is provided which branches off from at least one exhaust gas-conducting flow duct upstream of the at least one impeller.

The configuration of the exhaust-gas turbocharging may include difficulties, wherein it is basically sought to obtain a noticeable performance increase in all engine speed ranges. However, a torque drop is observed in the event of a certain engine speed being undershot. Said torque drop is understandable if one takes into consideration that the charge pressure ratio is dependent on the turbine pressure ratio. For example, if the engine speed is reduced, this leads to a smaller exhaust-gas mass flow and therefore to a lower turbine pressure ratio. This has the result that, toward lower engine speeds, the charge pressure ratio and the charge pressure likewise decrease, which equates to a torque drop.

It is sought, using a variety of measures, to improve the torque characteristic of a supercharged internal combustion engine. This maybe achieved, for example, by means of a small design of the turbine cross section and simultaneous provision of an exhaust-gas blow-off facility. Such a turbine is also referred to as a wastegate turbine. If the exhaust-gas mass flow exceeds a critical value, a part of the exhaust-gas flow is, within the course of the so-called exhaust-gas blow-off, conducted via the bypass line past the turbine. Said approach however has the disadvantage that the supercharging behavior is inadequate at relatively high engine speeds or in the case of relatively high exhaust-gas flow rates.

The torque characteristic may also be advantageously influenced by means of multiple exhaust-gas turbochargers connected in series. By connecting two exhaust-gas turbochargers in series, of which one exhaust-gas turbocharger serves as a high-pressure stage and one exhaust-gas turbocharger serves as a low-pressure stage, the compressor characteristic map can advantageously be expanded, specifically both in the direction of smaller compressor flows and also in the direction of larger compressor flows.

In particular, with the exhaust-gas turbocharger which serves as a high-pressure stage, it is possible for the surge limit to be shifted in the direction of smaller compressor flows, as a result of which high charge pressure ratios can be obtained even with small compressor flows, which considerably improves the torque characteristic in the lower engine speed range. This is achieved by designing the high-pressure turbine for small exhaust-gas mass flows and by providing a bypass line by means of which, with increasing exhaust-gas mass flow, an increasing exhaust-gas flow rate is conducted past the high-pressure turbine. For this purpose, the bypass line branches off from the exhaust-gas discharge system upstream of the at least one impeller of the high-pressure turbine and opens into the exhaust-gas discharge system again upstream of the low-pressure turbine, wherein a shut-off element is arranged in the bypass line in order to control the exhaust-gas flow conducted past the high-pressure turbine. The response behavior of an internal combustion engine supercharged in this way it may be considerably improved in relation to a similar internal combustion engine with single-stage supercharging, because the rotor of an exhaust-gas turbocharger of smaller dimensions can be accelerated more quickly, whereby the relatively small high pressure stage is less inert.

It is pointed out that the torque characteristic of a supercharged internal combustion engine may furthermore be improved by means of multiple turbochargers arranged in parallel, that is to say by means of multiple turbines of relatively small turbine cross section arranged in parallel, wherein turbines are activated successively with increasing exhaust-gas flow rate.

If a bypass line is provided, embodiments of the internal combustion engine may be advantageous in this context in which the at least one bypass line opens into the exhaust-gas discharge system downstream of the at least one impeller. Simply with regard to common exhaust-gas aftertreatment, a merging of the bypassed exhaust gas with the rest of the exhaust gas that has been conducted through the turbine is expedient and advantageous.

In this context, embodiments of the internal combustion engine may in turn be advantageous in which the at least one bypass line opens into an outlet region of the turbine. This makes it possible to realize a compact construction of the turbine unit as a whole together with bypass line.

In this context, embodiments of the internal combustion engine may also be advantageous in which the at least one bypass line is cooled at least in regions using the cooling arrangement. The bypass line and in particular the shut-off element provided in the bypass line are thermally highly loaded components. In the case of the shut-off element, the cooling arrangement serves in particular for maintaining the functionality of the shut-off element.

Embodiments of the internal combustion engine may be advantageous in which the shaft of the turbine is mounted in a bearing housing, wherein the bearing housing has at least one coolant duct on the impeller side. The liquid-cooled bearing housing supplements and supports the cooling arrangement of the turbine housing.

In the case of internal combustion engines in which the turbine has a turbine inlet region and/or a turbine outlet region, embodiments are advantageous wherein thermal insulation is provided, at the exhaust-gas side and at least in regions, in the turbine inlet region and/or in the turbine outlet region.

In the context of the present disclosure, the turbine inlet region and the turbine outlet region may belong to the turbine housing and thus also to the turbine.

The walls that form the turbine inlet region and turbine outlet region delimit the exhaust-gas discharge system at the inlet side and at the outlet side and may be—at least in regions—equipped with, that is to say coated, lined, surface-treated or the like, with thermal insulation. In the context of the present invention, thermal insulation may be distinguished from the housing material that is used very generally by the fact that the thermal insulation exhibits lower thermal conductivity than said material. The thermal permeability of the heat-transmitting surface, that is to say of the walls, is reduced, wherein it is the case, that heat can basically be introduced, this however being so to a lesser extent.

In the present case, the introduction of heat into the turbine at the inlet side and outlet side may be impeded by the introduction of thermal insulation, such that in individual cases, it is possible, though not imperative, for a cooling arrangement of the turbine inlet region and turbine outlet region to be dispensed with. Embodiments of the internal combustion engine may therefore also be advantageous in which the turbine inlet region and the turbine outlet region do not have a cooling arrangement or a coolant duct.

Embodiments of the internal combustion engine may be advantageous in which the turbine housing together with the at least one coolant duct and the at least one flow duct is a component cast in one piece. In individual cases, the turbine inlet region and the turbine outlet region likewise belong to the component of monolithic form; possibly also a wastegate.

By means of casting and the use of corresponding cores, a complex structure can be formed in one working step, such that subsequently only finish machining and the installation of the rotor are necessary in order to form the turbine. The advantages of a component of monolithic form as per the embodiment in question are in particular the compact construction and the omission of additional assembly working steps and the like. In this way, the monolithic component to be manufactured from gray iron or cast iron.

Embodiments of the internal combustion engine may also be advantageous in which the turbine housing together with the at least one coolant duct and the at least one flow duct is constructed in modular fashion from at least two components, that is to say is of multi-part form.

A modular construction in which at least two components are to be connected to one another has the basic advantage that the individual components can be used in different embodiments according to the construction kit principle. The versatility of a component generally increases the quantities produced, as a result of which the manufacturing costs can be reduced. The at least two components may be connected to one another in non-positively locking, positively locking and/or cohesive fashion.

Embodiments of the internal combustion engine are advantageous in which each cylinder may have two or three outlet openings for discharging the exhaust gases out of the cylinder.

It is the object of valve drives to open and close the outlet openings of the cylinders at the correct times, with fast opening of the largest possible flow cross sections being sought in order to keep the throttling losses in the outflowing exhaust gases low and in order to ensure effective, that is to say complete, discharge of the exhaust gases. It is therefore advantageous for the cylinders to be provided with two or more outlet openings.

Embodiments of the internal combustion engine may be advantageous in which the exhaust lines merge to form at least one overall exhaust line within the at least one cylinder head, thus forming at least one integrated exhaust manifold.

It may be taken into consideration that it is fundamentally sought to arrange the at least one turbine, in particular the turbine of an exhaust-gas turbocharger, as close as possible to the outlet of the cylinders in order thereby to be able to optimally utilize the exhaust-gas enthalpy of the hot exhaust gases, which is determined significantly by the exhaust-gas pressure and the exhaust-gas temperature, and to ensure a fast response behavior of the turbine or of the turbocharger. Furthermore, the path of the hot exhaust gases to the different exhaust-gas aftertreatment systems should also be as short as possible such that the exhaust gases may be given little time to cool down and the exhaust-gas aftertreatment systems reach their operating temperature or light-off temperature as quickly as possible, in particular after a cold start of the internal combustion engine.

It is therefore also sought to minimize the thermal inertia of the part of the exhaust line between the outlet opening at the cylinder and the turbine or between the outlet opening at the cylinder and the exhaust-gas aftertreatment system, which can be achieved by reducing the mass and the length of said part.

The exhaust lines may merge within the cylinder head so as to form at least one integrated exhaust manifold. The length of the exhaust lines may be reduced in this way. The line volume, that is to say the exhaust-gas volume of the exhaust lines upstream of the turbine, is reduced, such that the response behavior is improved. The shortened exhaust lines also lead to a reduced thermal inertia of the exhaust system upstream of the turbine, such that the temperature of the exhaust gases at the turbine inlet is increased, as a result of which the enthalpy of the exhaust gases at the inlet of the turbine is also higher. Furthermore, the merging of the exhaust lines within the cylinder head permits dense packaging of the drive unit.

However, a cylinder head with an integrated exhaust manifold may be thermally more highly loaded than a conventional cylinder head which is equipped with an external manifold, and may therefore place greater demands on the cooling arrangement. Embodiments of the internal combustion engine may be therefore also advantageous in which the at least one cylinder head is provided with at least one coolant jacket, which is integrated in the cylinder head, in order to form a liquid-type cooling arrangement.

A liquid-type cooling arrangement may be advantageous in particular in the case of supercharged engines because the thermal loading of supercharged engines is considerably higher than that of conventional internal combustion engines.

In this context, embodiments of the internal combustion engine may be advantageous in which the at least one coolant jacket that is integrated in the cylinder head is connected to at least one coolant duct of the turbine housing.

If the at least one coolant jacket which is integrated in the cylinder head is connected to the at least one coolant duct of the turbine housing, the other components and assemblies required to form a cooling circuit need basically be provided only singularly, as these may be used both for the cooling circuit of the turbine housing and also for that of the internal combustion engine, which may lead to synergies and cost savings, but also entails a weight saving.

For example, it is preferable for only one pump for conveying the coolant, and one container for storing the coolant, to be provided. The heat dissipated to the coolant in the cylinder head and in the turbine housing can be extracted from the coolant in a common heat exchanger. Furthermore, the at least one coolant duct of the turbine housing may be supplied with coolant via the cylinder head.

Embodiments of the internal combustion engine are advantageous in which at least one coolant duct in the turbine housing runs, at least in sections, in looped fashion around the shaft. In the present case, a coolant duct need not form a complete loop, but rather may form merely a section of a loop or more, that is to say at least one arcuate section which lies or extends circumferentially around the shaft of the turbine; if appropriate on a circular arc.

Embodiments of the internal combustion engine may also be advantageous in which at least one coolant duct runs, at least in sections, to the side of at least one exhaust-gas-conducting flow duct and so as to be spaced apart from said flow duct in the direction of the shaft. Here, a coolant duct may also change sides, that is to say may run laterally with respect to the exhaust-gas-conducting flow duct and then lead across the flow duct to the other side of the flow duct, in order to extend onward there laterally with respect to the flow duct. The coolant duct and the flow duct are preferably spaced apart to the same extent from the shaft.

Embodiments of the internal combustion engine may be advantageous in which at least one coolant duct extends, at least in sections, circumferentially around and so as to be spaced apart from at least one flow duct. The coolant duct and the flow duct are then, at least in sections, spaced apart to different extents from the shaft. Embodiments may also be advantageous in which at least two coolant ducts are provided for forming a cooling arrangement of the turbine housing.

The provision of more than one coolant duct is conducive to the homogenization of the temperature distribution in the housing, that is to say to a depletion of the temperature gradients and stresses that arise in the housing out of principle in conjunction with a cooling arrangement. The turbine may be equipped with a variable turbine geometry, which permits a more precise adaptation to the respective operating point of an internal combustion engine by means of an adjustment of the turbine geometry or of the effective turbine cross section. Here, adjustable guide blades for influencing the flow direction are arranged in the inlet region of the turbine. In contrast to the impeller blades of the rotating impeller, the guide blades do not rotate with the shaft of the turbine.

If the turbine has a fixed, invariable geometry, the guide blades are arranged in the inlet region so as to be not only stationary but rather also completely immovable, that is to say rigidly fixed, if a guide device is provided. In contrast, in the case of a variable geometry, the guide blades are duly arranged so as to be stationary but not so as to be completely immovable, rather so as to be rotatable about their axis, such that the flow approaching the impeller blades can be influenced.

By contrast to a fixed, invariable geometry, a variable turbine geometry is even less thermally loadable owing to the movable components, whereby the cooling of a turbine that is equipped with a variable turbine geometry is particularly advantageous.

DETAILED DESCRIPTION

Figure 1:
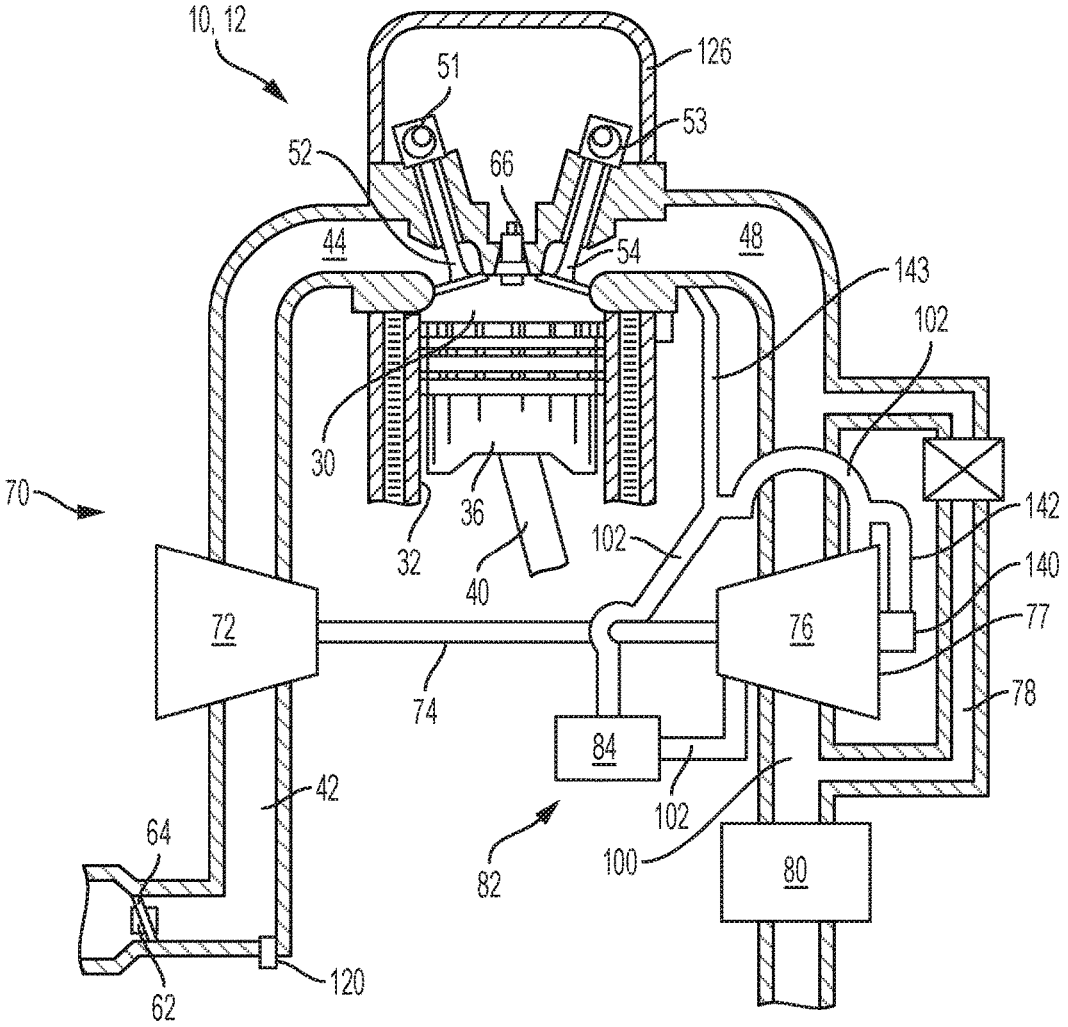
FIG. 1 is a schematic view illustrating an internal combustion engine including a liquid-cooled turbine in accordance with the present disclosure.

FIG. 1 is a schematic diagram showing one cylinder of multi-cylinder engine 10, which may be included in a propulsion system of an automobile. Engine 10 may be controlled at least partially by a control system (not shown) and by input from a vehicle operator via an input device (not shown), for example, an accelerator pedal coupled with and a pedal position sensor for generating a proportional pedal position signal PP. Combustion chamber (i.e., cylinder) 30 of engine 10 may include combustion chamber walls 32 with piston 36 positioned therein. Piston 36 may be coupled to a tie rod 40 so that reciprocating motion of the piston is translated into rotational motion of a crankshaft (no shown) via the tie rod 40. Crankshaft may be coupled to at least one drive wheel of a vehicle via an intermediate transmission system. Further, a starter motor may be coupled to crankshaft via a flywheel (not shown) to enable a starting operation of engine 10. A lubrication system in the form of oil distribution system may be provided to direct oil to lubricate the engine 10. Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include fixed cam timing, or may include one or more cams and may utilize one or more of cam profile switching (CPS), variable cam timing (VCT), variable valve timing (VVT) and/or variable valve lift (VVL) systems that may be operated by controller (not shown) to vary valve operation. The position of intake valve 52 and exhaust valve 54 may be determined by position sensors (not shown). In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

A fuel injector 66 is shown coupled directly to combustion cylinder 30 for injecting fuel directly therein in proportion to the pulse width of signal FPW received from controller 12 via, for example, an electronic driver. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not included). In some embodiments, combustion cylinder 30 may alternatively or additionally include a fuel injector arranged in intake passage 42 in a configuration that provides what is known as port injection of fuel into the intake port upstream of combustion cylinder 30.

Intake passage 42 may include a charge motion control valve (CMCV) and a CMCV plate (not shown) and may also include a throttle 62 having a throttle plate 64. In this particular example, the position of throttle plate 64 may be varied by, for example the controller via a signal provided to an electric motor or actuator included with throttle 62, a configuration that may be referred to as electronic throttle control (ETC). In this manner, the throttle 62 may be operated to vary the intake air provided to combustion cylinder 30 among other engine combustion cylinders. Intake passage 42 may include a mass air flow sensor 120 and a manifold air pressure sensor (not shown) for providing respective signals MAF and MAP to controller.

The engine 10, or engine system 12 may include a turbocharger 70, wherein a compressor 72 configured to compress intake air, may be driven, via shaft 74, by turbine 76. The turbine 76 may be driven by exhaust passing through exhaust gas passage 100 from the combustion chamber 30. A bypass line 78 may be configured to allow some or all of the exhaust to bypass the turbine 76. An exhaust treatment element 80 may be positioned downstream from the turbine 76.

A coolant system 82 may be provided to at least partially regulate the temperature of the turbine 76, and/or turbine housing 77. The coolant system 82 may include additional elements 84, for example, one or more valves, a reservoir, a pump, and the like. A coolant fluid duct or coolant passage 102 may direct a coolant through and/or around the turbine housing 77 to absorb heat from the housing 77 that may have been absorbed from the exhaust flow passing through the exhaust gas passage 100.

As described above, FIG. 1 shows only one cylinder of a multi-cylinder engine, however it can be appreciated that each cylinder may similarly include its own set of intake/exhaust valves, fuel injector, etc.

Figure 2A:
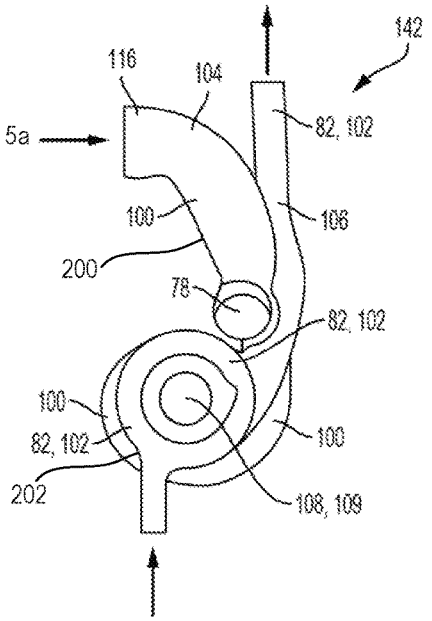
FIG. 2A is a top sectional view illustrating example casting cores that may be used to fabricate an example housing for a liquid-cooled turbine in accordance with the present disclosure.
Figure 2B:
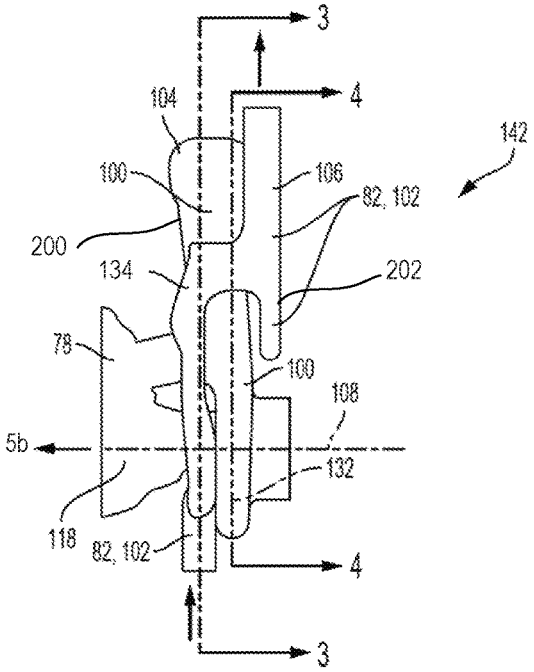
FIG. 2B is a side view illustrating the casting cores shown in FIG. 2A.
Figure 3:
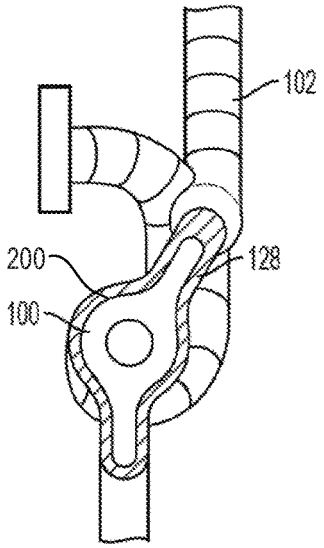
FIG. 3 is a sectional view illustrating example shapes and positions of an exhaust passage and a coolant passage, which may be formed from a casting operation using the casting cores illustrated in FIGS. 2A and 2B, and wherein the section may be considered cut from a corresponding cast part at line 3-3 in FIG. 2B. (Some material is not included to show the shapes of the passages.)
Figure 4:
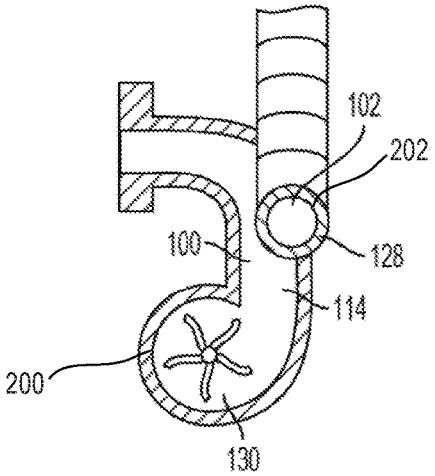
FIG. 4 is a sectional view similar to FIG. 3 taken at line 4-4 in FIG. 2B.
Figure 5:
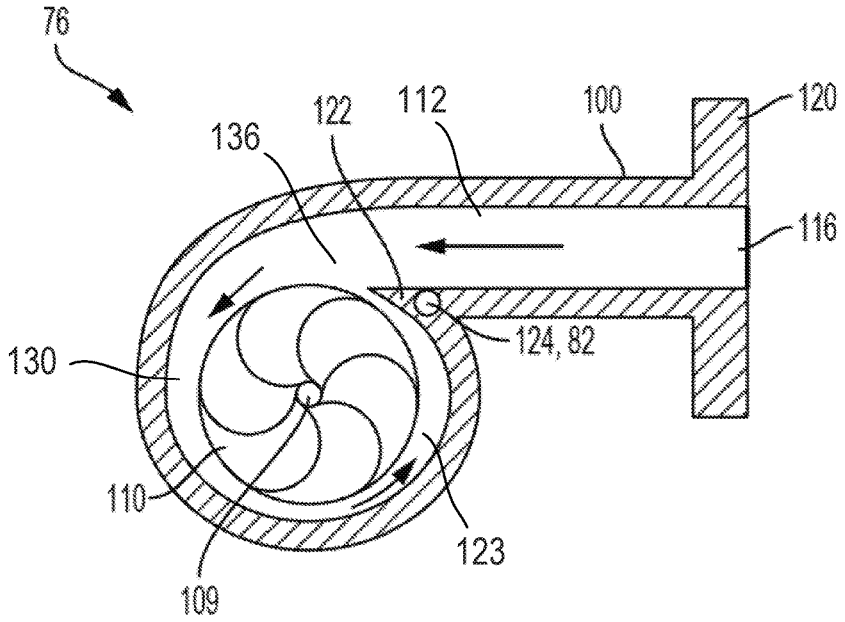
FIG. 5 is a sectional view illustrating a second embodiment of a turbine housing in accordance with the present disclosure.

FIG. 2A shows some casting cores 104, 106 of the liquid-cooled turbine 76 of a first embodiment of the internal combustion engine 10 in a section perpendicular to an axis of rotation 108 of the turbine impeller 110 (FIG. 5). The axis of rotation 108 for the impeller 110 of the turbine 76 is consequently perpendicular to the plane of the drawing. FIG. 2A shows the casting cores 104, 106 illustrated in FIG. 2A in a view rotated through 90°, with the view directed toward the shaft 108 of the turbine impeller 110.

The casting cores serve for forming the cavities 114 of the turbine housing 77 and thus in particular for forming the exhaust-gas-conducting flow duct 100 and the coolant duct 102 provided for forming a cooling arrangement 82.

The coolant enters the coolant duct 102, which forks and lies in looped fashion, in the present case in circular fashion, around the shaft 109 and which runs laterally with respect to the flow duct 100 and so as to be spaced apart from the flow duct 100 in the direction of the shaft 109. The coolant duct 102 changes sides downstream, that is to say leads across the flow duct 100 to the other side of the flow duct 100, in order to extend onward there laterally with respect to the flow duct 100, or at the bearing housing side, as far as the coolant outlet (indicated by arrows).

The turbine 76 is supplied with exhaust gas from the internal combustion engine 10. The exhaust gas enters the turbine housing 77 or the flow duct 100 via a turbine inlet region 5*a* (indicated by a double arrow).

The flow duct 100 which conducts the exhaust gas through the turbine housing 77 extends in spiral fashion around the axis of rotation 108 of the impeller 110 and opens, downstream of the impeller 110, into the conical turbine outlet region 5*b*, from which the exhaust gas emerges axially in the direction of the axis of rotation 108 (indicated by a double arrow).

For the purposes of bypassing the turbine or the impeller, a bypass line 78 is provided which branches off from the exhaust-gas-conducting flow duct 100 upstream of the impeller 110 and which opens into the outlet region 118 of the turbine downstream of the impeller.

The surface area exposed to exhaust gas Aexhaust 200 of the exhaust-gas-conducting flow duct 100 and the surface area exposed to coolant Acoolant 202 of the coolant duct 102 in the present case form an area ratio Acoolant/Aexhaust≈0.43.

FIG. 5 shows the radial turbine 76 of a second embodiment of the internal combustion engine in a section perpendicular to the shaft 109 of the turbine impeller 110. The shaft 109 forms the axis of rotation 108 for the impeller 110 of the turbine 76 and is perpendicular to the plane of the drawing.

The radial turbine 76 comprises a turbine housing 77 in which there is arranged an impeller 110 which is mounted rotatably on a shaft 109. In order that the rotor blades can be approached by flow radially, the housing 1*a* for the supply of the exhaust gas is in the form of an encircling spiral housing. Proceeding from an inlet region 116 which is formed in a flange 120, the hot exhaust gas flows through a flow duct 100 which extends in spiral fashion around the impeller 110. The end of the flow duct 100 forms a housing tongue 122 which, in the present case, is an integral constituent part of the turbine housing 77 and which extends as far as the outer circumference of the impeller 110.

To form a liquid-type cooling arrangement 82 in the region of the thermally highly loaded housing tongue 122, the turbine housing 77 has an additional coolant duct 124 which leads through the housing tongue 122. Said coolant duct 124 runs rectilinearly and extends parallel to the axis of rotation 108 of the impeller 110. In the present case, the duct 124 has been formed into the housing 77 or into the housing tongue 122 by drilling.

Various embodiments may provide an internal combustion engine 10 having at least one cylinder head 126 and having at least one turbine 76 including a turbine housing 77. The turbine housing including an exhaust gas passage 100, at least one coolant fluid passage 102, and a wall 128 between the exhaust gas passage 100 and the at least one coolant fluid passage 102. The at least one coolant fluid passage 102 having a first area (Aexhaust) 200 disposed to absorb heat from an exhaust flow passing through the exhaust gas passage, and a second area (Acoolant) 202 disposed to transfer heat from the wall to be absorbed by a coolant fluid flow passing through the at least one coolant fluid passage, wherein the following applies: Acoolant/Aexhaust≤1.2. In some embodiments the following applies: Acoolant/Aexhaust≤0.5.

In various embodiments the turbine housing the exhaust gas passage 100 and the at least one coolant fluid passage 102 may be a unitary component cast as one piece. In some cases the at least one coolant fluid passage 102 may run, at least in sections, in looped fashion around an axis 108 upon which an impeller may be rotatable. The at least one coolant fluid passage may be spaced apart from said exhaust gas passage 100 and offset to one side thereof in a direction substantially parallel with an axis 108 upon which an impeller may be rotatable. The at least one cooling jacket may be integrated into the cylinder head 126 and configured to receive the coolant fluid flow which also passes through the at least one coolant fluid passage 100.

Various embodiments may provide a turbine housing 77. The turbine housing 77 may include an exhaust gas passage 100 having a curvilinear portion 114 extending into a substantially discoid impeller receiving portion 130. The discoid impeller receiving portion 130 may define a discoid plane 132. A coolant fluid passage 102 may be formed integrally with the exhaust gas passage 100 in a casting operation, and may have a first portion leading into a toroidal portion 134. The toroidal portion 134 may be located substantially parallel with, and on a first side of, the discoid plane 132. The toroidal portion 134 may extend into a curvilinear section which may pass to a second side of the discoid plane 132. The turbine housing 77 may also include a thermally transmissive intermediate portion 128 between the exhaust gas passage 100 and the coolant fluid passage 102 wherein substantially all heat to pass from an exhaust flow passing through the exhaust gas passage and into a coolant fluid flow that may pass through the coolant fluid passage may be transferred through an exhaust area Aexhaust 200 on an inside surface of the exhaust gas passage 100 and through a coolant area Acoolant 202 on an inside surface of the coolant fluid passage 102, wherein the following applies: Acoolant/Aexhaust≤1.2.

As illustrated in FIG. 5, with some embodiments the exhaust gas passage 100 may include a tongue portion 122 at a junction region 136 between the first portion 112 and the discoid portion 123. An additional coolant duct 124 may be defined in the tongue portion 122.

In some embodiments, the turbine housing 77 may include at least one bypass line 78, and may be configured to branch off from the exhaust gas passage 100 upstream from the impeller receiving portion 130. The at least one bypass line 78 may open into the gas passage 100 downstream of impeller receiving portion 130. The bypass line 78 may be configured to be cooled by the coolant fluid flow passing through the coolant fluid passage 102.

The turbine housing 77 may include a bearing housing 140 configured to house one or more bearings to support an impeller 110 for rotation within the impeller receiving portion 130. The bearing housing has at least one coolant duct 142 configured to be cooled by the coolant fluid flow passing through the coolant fluid passage 102. The at least one coolant duct 142 may be configured as a junction line extending from the coolant fluid passage 102. The cylinder head 126 may be cooled with an additional junction line 143 fluidically coupled with the coolant fluid passage 102.

As discussed, the turbine housing 77 may include a turbine inlet region 116 and a turbine outlet region 118. In some embodiments thermal insulation may be disposed at the turbine inlet 116, and the turbine outlet region 118 at least on an exhaust-gas side thereof.

Various embodiments may provide a casting core arrangement 142 for forming a turbocharger turbine housing 77. The casting core arrangement 142 may include a first removable or destructible core element 104 which may be positionable within a mold to form an exhaust gas passage 100 upon completion of a casting operation. A second removable or destructible core element 106 may be positionable within the mold to form a coolant fluid passage 102 upon completion of the casting operation. Embodiments may include a space defined between the first and second core elements 104, 106 to form a thermal transfer wall 128 between the exhaust gas passage 100, and the coolant fluid passage 102 upon completion of the casting operation. The wall 128 may have a first surface area (Afirst) to absorb heat from an exhaust gas flow, and a second surface area ($A_{second}$) to allow heat to be carried away from the wall by a coolant fluid flow, wherein the following applies $(A_{second})/(A_{first})\leq 1.2$. In some embodiments the following may apply $(A_{second})/(A_{first})\leq 1.0$. In some embodiments the following may apply $(A_{second})/(A_{first})\leq 0.8$. In some embodiments the following may apply $(A_{second})/(A_{first})\leq 0.65$. In some embodiments the following may apply $(A_{second})/(A_{first})\leq 0.55$.

The exhaust gas passage 100 may define an impeller chamber 130 and a flow duct 112 directed into the impeller chamber 130. A tongue 122 may be located at a transitional region 136 between the flow duct and the impeller chamber 130. The second core element 106 may be positionable within the mold to form a second or additional coolant fluid passage 124 within the tongue 122.

The exhaust gas passage 100 may define an impeller chamber 130 and a flow duct 112 directed into the impeller chamber 130. A tongue 122 may be located at a transitional region 136 between the flow duct 112 and the impeller chamber 130. An additional coolant fluid passage 124 may be formed within the tongue 122 after the casting operation wherein (Asecond) may include an inside area from the additional coolant fluid passage. The impeller chamber 130 may be defined to house an impeller rotatable on a shaft 109, and the additional coolant fluid passage 124 may be oriented substantially parallel with the shaft 109. The coolant passage 102 and the additional coolant fluid passage 124 may form an integrated coolant passage flow circuit wherein the additional coolant fluid passage may be a branch of the coolant passage.

It will be appreciated by those skilled in the art that although the present disclosure has been described by way of example with reference to one or more embodiments it is not limited to the disclosed embodiments and that one or modifications to the disclosed embodiments or alternative embodiments could be constructed without departing from the scope of the present disclosure.

Accordingly, it will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An internal combustion engine having at least one cylinder head and having at least one turbine comprising:
- a turbine housing including:
  - an exhaust gas passage;
  - at least one coolant fluid passage; and
  - a wall between the exhaust gas passage and the at least one coolant fluid passage having:
    - a first area ($A_{exhaust}$) contacting exhaust gases; and
    - a second area ($A_{coolant}$) contacting coolant, and
    - wherein the following applies: $A_{coolant}/A_{exhaust}\leq 1.2$.

2. The internal combustion engine of claim 1, wherein the following applies: $A_{coolant}/A_{exhaust}\leq 0.5$.

3. The internal combustion engine of claim 1, wherein the turbine housing the exhaust gas passage and the at least one coolant fluid passage is a unitary component cast as one piece.

4. The internal combustion engine of claim 1, wherein the at least one coolant fluid passage runs, at least in sections, in a looped fashion around an axis upon which an impeller is rotatable.

5. The internal combustion engine of claim 1, wherein the at least one coolant fluid passage is spaced apart from said exhaust gas passage and offset to one side thereof in a direction substantially parallel with an axis upon which an impeller is rotatable.

6. The internal combustion engine of claim 1, further comprising at least one cooling jacket integrated into the cylinder head and configured to receive coolant fluid flow which also passes through the at least one coolant fluid passage.

7. A turbine housing comprising:

an exhaust gas passage having a curvilinear portion extending into a substantially discoid impeller receiving portion, the discoid impeller receiving portion defining a discoid plane;

a coolant fluid passage formed integrally with the exhaust gas passage in a casting operation, and having a first portion leading into a toroidal portion, the toroidal portion located substantially parallel with and on a first side of the discoid plane and extending into a curvilinear section which passes to a second side of the discoid plane; and a thermally transmissive intermediate portion between the exhaust gas passage and the coolant fluid passage, wherein substantially all heat to pass from an exhaust flow passing through the exhaust gas passage and into a coolant fluid flow passing through the coolant fluid passage is transferred through an exhaust area $A_{exhaust}$ on an inside surface of the exhaust gas passage and through a coolant area $A_{coolant}$ on an inside surface of the coolant fluid passage, wherein the following applies: $A_{coolant}/A_{exhaust} \leq 1.2$.

8. The turbine housing of claim 7, wherein the exhaust gas passage includes a tongue portion at a junction region between the first portion and a discoid portion, and an additional coolant duct defined in the tongue.

9. The turbine housing of claim 7, further comprising at least one bypass line configured to branch off from the exhaust gas passage upstream from the impeller receiving portion and which opens into a gas passage downstream of the impeller receiving portion wherein the bypass line is configured to be cooled by the coolant fluid flow passing through the coolant fluid passage.

10. The turbine housing of claim 7, further comprising a bearing housing configured to house one or more bearings to support an impeller for rotation within the impeller receiving portion, wherein the bearing housing has at least one coolant duct configured to be cooled by the coolant fluid flow passing through the coolant fluid passage.

11. The turbine housing of claim 7, further comprising a turbine inlet region and a turbine outlet region, and thermal insulation disposed at the turbine inlet and the turbine outlet regions at least on an exhaust-gas side thereof.

12. A casting core arrangement for forming a turbocharger turbine housing comprising:

a first removable or destructible core element positionable within a mold to form an exhaust gas passage;

a second removable or destructible core element positionable within the mold to form a coolant fluid passage; and a wall between the exhaust gas passage and the coolant fluid passage formed in a space between the first and second core elements;

wherein the coolant fluid passage extends around a turbine shaft and along the exhaust gas passage leading to a turbine.

13. The casting core arrangement of claim 12, wherein the exhaust gas passage defines an impeller chamber and a flow duct directed into the impeller chamber, and a tongue at a transitional region between the flow duct and the impeller chamber; and wherein the second core element is positionable within the mold to form a coolant fluid passage within the tongue.

14. The casting core arrangement of claim 12, wherein the exhaust gas passage defines an impeller chamber and a flow duct directed into the impeller chamber, and a tongue at a transitional region between the flow duct and the impeller chamber; and wherein an additional coolant fluid passage formed within the tongue after a casting operation wherein a second surface area ($A_{second}$) contacting coolant includes an inside area from the additional coolant fluid passage.

15. The casting core arrangement of claim 14, wherein the impeller chamber is defined to house an impeller rotatable on a shaft, and the additional coolant fluid passage is oriented substantially parallel with the shaft.

16. The casting core arrangement of claim 14, wherein the coolant fluid passage and the additional coolant fluid passage form an integrated coolant passage flow circuit, and wherein the additional coolant fluid passage is a branch of the coolant fluid passage.

17. The internal combustion engine of claim 1, wherein the following applies: $(A_{exhaust})/(A_{coolant}) \leq 0.55$.

18. The casting core arrangement of claim 12, wherein the coolant fluid passage extends along only one side of the exhaust gas passage surrounding the turbine.

19. The casting core arrangement of claim 18, wherein the coolant fluid passage includes a cross over passage which extends to an opposite side of the exhaust gas passage.

20. The casting core arrangement of claim 19, wherein the coolant fluid passage is connected to a coolant duct which travels through a tongue, wherein the tongue is positioned between an impeller chamber and the exhaust gas passage.

* * * * *